US005682827A

United States Patent [19]

Nagato et al.

[11] Patent Number: 5,682,827

[45] Date of Patent: Nov. 4, 1997

[54] FLUIDIZED-BED COMBUSTOR

[75] Inventors: Shuichi Nagato; Takahiro Oshita, both of Kanagawa-ken, Japan

[73] Assignee: Ebara Corporation, Tokyo, Japan

[21] Appl. No.: 471,204

[22] Filed: Jun. 6, 1995

[30] Foreign Application Priority Data

Apr. 26, 1995 [JP] Japan ..... 7-102634

[51] Int. Cl.[6] ..... F23G 5/00

[52] U.S. Cl. ..... 110/244; 110/245

[58] Field of Search ..... 110/243, 244, 110/245

[56] References Cited

U.S. PATENT DOCUMENTS

| | | | |
|---|---|---|---|
| 4,419,330 | 12/1983 | Ishihara et al. | 110/245 |
| 4,938,170 | 7/1990 | Ohshita et al. | 110/245 |

FOREIGN PATENT DOCUMENTS

| | | |
|---|---|---|
| 53-102138 | 1/1952 | Japan . |
| 52-118858 | 10/1977 | Japan . |
| 57-124608 | 8/1982 | Japan . |
| 4-208304 | 7/1992 | Japan . |
| 4-214110 | 8/1992 | Japan . |
| 4-2177708 | 8/1992 | Japan . |
| 4-122926 | 11/1992 | Japan . |
| 5-19044 | 3/1993 | Japan . |
| 89/00659 | 1/1989 | WIPO . |

*Primary Examiner*—John T. Kwon

*Attorney, Agent, or Firm*—Wenderoth, Lind & Ponack

[57] ABSTRACT

A fluidized-bed combustor combusts combustible material smoothly while smoothly removing any incombustible material or components from the fluidized-bed furnace without depositing the incombustible material or components therein. The fluidized-bed combustor has a first diffuser plate, a second diffuser plate each having a plurality of fluidizing gas supply holes, and an incombustible material discharge port disposed between the first diffuser plate and the second diffuser plate. A portion of the fluidizing gas is supplied from the incombustible material discharge port to generate an uninterrupted fluidized bed on the bottom of the fluidized-bed furnace. The first diffuser plate has a downwardly inclined surface directed toward the incombustible material discharge port, and the second diffuser plate has an upwardly inclined surface which is progressively higher away from the incombustible material discharge port.

11 Claims, 7 Drawing Sheets

FLUIDIZED-BED COMBUSTOR

BACKGROUND OF THE INVENTION

1. Field of the Invention

The present invention relates to a fluidized-bed combustor for combusting solid combustible material containing incombustible material or components, e.g., industrial waste, municipal garbage, coal, etc. in a fluidized-bed furnace, and more particularly to a fluidized-bed combustor for discharging incombustible material smoothly from a fluidized-bed furnace to avoid a deposit of incombustible material in a certain location in the fluidized-bed furnace and uniformly combusting solid combustible material to recover thermal energy stably therefrom.

2. Description of the Prior Art

As economy develops, more and more solid combustible material containing incombustible material, e.g., industrial waste, municipal garbage, etc. is produced as a result of various human activities. This solid combustible material contains a large amount of energy that can be used. However, it is difficult to combust the solid combustible material stably to utilize its energy because the solid combustible material is available in a wide variety of natures and configurations and contains a large quantity of incombustible material or components of indeterminate shape mixed therewith.

Japanese laid-open patent publication (JP-A) No. 4-214110 discloses a fluidized-bed combustor which combusts waste material containing incombustible material or components in a fluidized-bed furnace, and discharges the incombustible material or components smoothly from the fluidized-bed furnace to allow the waste material to be combusted stably in the fluidized-bed furnace. In the disclosed fluidized-bed combustor shown in FIG. 1 of this publication, an incombustible material discharge port 50 is defined between an air diffuser plate 40 and a furnace wall, and the air diffuser plate 40 has an inclined upper surface 44 inclined such that the incombustible material discharge port 50 is located in a lower position. More air is supplied to a lower region of the air diffuser plate 40 than to a higher region of the air diffuser plate 40. However, since a fluidized medium is intensely fluidized in the lower region of the air diffuser plate 40 by a large amount of air supplied thereto, a fluidized bed has a characteristic similar to liquid. Therefore, material of larger specific gravity than the fluidized medium descends in the fluidized bed, and material of smaller specific gravity than the fluidized medium floats in the fluidized bed, thus creating so-called specific gravity separation. As a result, incombustible material of a large specific gravity descends in the fluidized bed, and is deposited on the bottom of the furnace before reaching the incombustible material discharge port 50. Further, since the incombustible material discharge port 50 to which a fluidizing gas is not supplied is open in the bottom of the furnace, the fluidized bed above the incombustible material discharge port 50 is not stabilized.

A fluidized-bed combustor shown in FIG. 11 of the above publication (No. 4-214110) has air diffuser plates 90*a*, 90*b* having respective downwardly inclined surfaces which extend from the center of a fluidized-bed furnace toward two incombustible material discharge ports 95*a*, 95*b*, and air diffuser plates 90*c*, 90*d* having respective downwardly inclined surfaces which extend from a furnace side wall toward the incombustible material discharge ports 95*a*, 95*b*. While more air is supplied from the regions of the air diffuser plates next to the incombustible material discharge ports through air chambers 93*c*, 93*e* than from other regions, a fluidized bed in which a fluidized medium is intensely fluidized by a large amount of air supplied thereto has a characteristic similar to liquid. Therefore, material of larger specific gravity than the fluidized medium descends in the fluidized bed, and material of smaller specific gravity than the fluidized medium floats in the fluidized bed, thus creating so-called specific gravity separation. As a result, incombustible material of a large specific gravity descends in the fluidized bed, and is deposited on the bottom of the furnace before reaching the incombustible material discharge ports 95*a*, 95*b*. Thus, the incombustible material cannot be discharged smoothly, and fluidization of the fluidized medium is not carried out smoothly, resulting in malfunction of the furnace. Further, since the incombustible material discharge ports in which a fluidizing gas is not introduced are open in the bottom of the furnace as viewed in plan, a fixed bed in which the fluidized medium is not fluidized is formed at the region near or above the incombustible material discharge ports. Therefore, the fixed bed prevents a circulating flow in the fluidized bed from being formed, dispersion and mixture of combustible material in the fluidized bed are not effectively carried out, and incombustible material cannot be smoothly discharged out of the furnace.

Japanese patent publication (JP-B2) No. 5-19044 discloses a fluidized-bed furnace for incinerating waste material containing incombustible material such as metal pieces, soil, and rocks. The disclosed fluidized-bed furnace has a furnace bed including downwardly inclined surfaces extending toward an incombustible material discharge port 5 disposed centrally in the furnace bed. Fluidizing air is supplied such that the amount of fluidizing air per unit area of the furnace bed is larger in the vicinity of the incombustible material discharge port and decreases stepwise toward a furnace side wall. Therefore, a circulating flow of the fluidized medium which ascends at the region near the incombustible material discharge port 5 located at the central part of the furnace and descends in the vicinity of the side wall of the furnace is formed, but combustible waste is supplied from a supply port located above the incombustible material discharge port 5, thus the combustible waste is blown up by an upward flow and combusted on the fluidized bed or in the free board, resulting in lowering combustion efficiency in the fluidized bed.

In order to prevent the above disadvantages, in case of supplying the combustible waste from the side wall of the furnace, dispersion and mixture of the combustible waste in the fluidized bed are improved because the combustible waste is entrained by the descending flow. However, since a large amount of air is supplied to the region near the incombustible material discharge port 5, the fluidized bed in which the fluidized medium is intensely fluidized in such region has a characteristic similar to liquid as in the fluidized-bed furnace of JP-A-4-214110. Therefore, material of larger specific gravity than the fluidized medium descends in the fluidized bed, and material of smaller specific gravity than the fluidized medium floats in the fluidized bed, thus creating specific gravity separation. As a result, incombustible material of a large specific gravity descends in the fluidized bed, is deposited on the bottom of the furnace before reaching the incombustible material discharge port, and cannot be smoothly discharged out of the furnace.

SUMMARY OF THE INVENTION

It is therefore a general object of the present invention to provide a fluidized-bed combustor for combusting solid combustible material containing incombustible material, e.g., industrial waste, municipal garbage, coal, etc. in a fluidized-bed furnace, the fluidized-bed combustor being capable of removing incombustible material of a large specific gravity smoothly from the fluidized-bed furnace to prevent those incombustible material from being deposited in a certain location in the fluidized-bed furnace for thereby stabilizing fluidization in the fluidized-bed furnace and uniformly combusting the combustible material.

Incombustible material of a large specific gravity, such as iron or the like, is less susceptible to descending and capable of moving horizontally when supported by a moving bed (the transient state of a fluidized medium between a fixed bed and a fluidized bed), but is quickly settled down and deposited and cannot easily be moved in a fluidized bed in which the fluidized medium is violently fluidized. Thus, it is difficult to discharge the incombustible material out of the furnace.

In view of the above fact, it is a specific object of the present invention to provide a fluidized-bed combustor which is capable of moving combustible material containing incombustible material supplied into a fluidized-bed furnace to a position in the vicinity of an incombustible material discharge port with a fluidized medium, violently fluidizing the fluidized medium and rapidly combusting the combustible material in the vicinity of the incombustible material discharge port, and settling and separating incombustible material of a large specific gravity to discharge it from the incombustible material discharge port.

Another object of the present invention is to provide a fluidized-bed combustor in which the flow of a fluidizing gas is not interrupted by an incombustible material discharge port to thereby stabilize a main fluidized bed and a main circulating flow of a fluidized medium which are produced in a fluidized-bed furnace for combusting combustible material effectively.

Still another object of the present invention is to provide a fluidized-bed combustor in which while combustible material containing incombustible material supplied into a fluidized-bed furnace is moving in descending and horizontal flows of a fluidized medium, the combustible material is separated by a selective action of a fluidizing gas into an upper fluidized bed having a high combustible material concentration with a small specific gravity and a lower fluidized bed having a high incombustible material concentration with a large specific gravity, the upper fluidized bed flows beyond an incombustible material discharge port and is mixed with an upward flow for further circulation, and the incombustible material and fluidized medium in the lower fluidized bed are extracted with priority out of the fluidized-bed furnace through the incombustible material discharge port.

Yet still another object of the present invention is to provide a fluidized-bed combustor which is capable of effectively discharging incombustible material out of a fluidized-bed furnace, and has a heat collector disposed in an auxiliary fluidized bed that is produced separately from a main fluidized bed, for stably recovering thermal energy.

According to the present invention, there is provided a fluidized-bed combustor for combusting combustible material containing incombustible material in a fluidized-bed furnace, comprising: a first diffuser plate disposed at a bottom of the fluidized-bed furnace and having a plurality of holes for supplying a fluidizing gas with a relatively low fluidizing gas velocity; a second diffuser plate disposed at a bottom of the fluidized-bed furnace and having a plurality of holes for supplying a fluidizing gas with a relatively high fluidizing gas velocity; an incombustible material discharge port for discharging the incombustible material out of the fluidized-bed furnace, the incombustible material discharge port being defined between the first diffuser plate and the second diffuser plate; a combustible material supply port disposed above the first diffuser plate for supplying the combustible material into the fluidized-bed furnace; and a diffuser device for supplying a fluidizing gas through the incombustible material discharge port into the fluidized-bed furnace; wherein the first diffuser plate has a downwardly inclined surface directed to the incombustible material discharge port and supplies the fluidizing gas so as to fluidize a fluidized medium at a relatively low fluidizing speed and create a descending flow of the fluidized medium; and the second diffuser plate supplies the fluidizing gas so as to fluidize the fluidized medium at a relatively high fluidizing speed and create an upward flow of the fluidized medium.

The fluidized medium forms a main circulating flow which includes descending and upward flows. A fluidizing gas is supplied from the incombustible material discharge port to continue a main fluidized bed in the vicinity of the incombustible material discharge port for thereby stabilizing the main circulating flow.

While combustible material containing incombustible material supplied from the combustible material supply port into the fluidized-bed furnace is descending with the descending flow of the fluidized medium toward the bottom of the fluidized-bed furnace and horizontally moving along the downwardly inclined surface of the first diffuser plate, the combustible material is separated by a selective action of an upwardly supplied fluidizing gas into an upper fluidized bed having a high combustible material concentration with a small specific gravity and a lower fluidized bed having a high incombustible material concentration with a large specific gravity. The upper fluidized bed flows beyond the incombustible material discharge port and is mixed with the upward flow of the moving fluidized medium for further circulation and combustion. The incombustible material and the fluidized medium in the lower fluidized bed are extracted with priority out of the fluidized-bed furnace through the incombustible material discharge port.

Preferably, the fluidized-bed combustor further comprises an auxiliary diffuser plate disposed between the first diffuser plate and the incombustible material discharge port, the auxiliary diffuser plate having a plurality of fluidizing gas supply holes defined therein for supplying a fluidizing gas so as to fluidize the fluidized medium at a relatively high fluidizing speed, the auxiliary diffuser plate having a downwardly inclined surface extending between a lower edge of the first diffuser plate and the incombustible material discharge port and being steeper than the first diffuser plate. The fluidized-bed furnace has an inclined wall disposed above the second diffuser plate for directing the fluidizing gas and the fluidized medium flowing upwardly of the second diffuser plate toward a region above the first diffuser plate, i.e., a central region of the fluidized-bed furnace. A free board is disposed above the inclined wall. The second diffuser plate has an upwardly inclined surface which is progressively higher away from the incombustible material discharge port and supplies the fluidizing gas having a progressively increasing fluidizing gas velocity away from the incombustible material discharge port.

The fluidized-bed combustor also comprises a thermal energy recovery chamber defined between the inclined wall and a side wall of the fluidized-bed furnace and being in communication with the central region of the fluidized-bed furnace above and below the inclined wall; a heat collector disposed in the thermal energy recovery chamber for recovering thermal energy from the fluidized medium in the thermal energy recovery chamber; and a third diffuser plate disposed between the second diffuser plate and the side wall of the fluidized-bed furnace and extending contiguously to an outer edge of the second diffuser plate, the third diffuser plate having a plurality of holes for supplying a fluidizing gas with a relatively low fluidizing gas velocity; wherein the third diffuser plate has an upwardly inclined surface which has the same gradient as the second diffuser plate and supplies the fluidizing gas to fluidize the fluidized medium at a relatively low fluidizing speed in the thermal energy recovery chamber.

The bottom of the fluidized-bed furnace may be of a rectangular or circular shape. If the bottom of the fluidized-bed furnace is of a rectangular shape, then the first diffuser plate, the incombustible discharge port, and the second diffuser plate, which are of a rectangular shape, may be disposed parallel to each other, or alternatively, the incombustible material discharge port and the second diffuser plate, which are of a rectangular shape, may be disposed symmetrically with respect to a ridge of the first diffuser plate which is of a rectangular, roof-shaped structure. If the bottom of the fluidized-bed furnace is of a circular shape, then the circular bottom of the fluidized-bed furnace is composed of the first diffuser plate which is of a conical shape having a central region higher than a circumferential edge thereof, the incombustible material discharge port comprising a plurality of arcuate sections disposed concentrically with the first diffuser plate, and the second diffuser plate which is of an annular shape disposed concentrically with the first diffuser plate.

According to the present invention, there is also provided a fluidized-bed combustor for combusting combustible material containing incombustible material in a fluidized-bed furnace, comprising: a first diffuser plate disposed at a bottom of the fluidized-bed furnace and having a plurality of holes for supplying a fluidizing gas with a relatively low fluidizing gas velocity; an auxiliary diffuser plate disposed at a bottom of the fluidized-bed furnace and having a plurality of holes for supplying a fluidizing gas with a relatively high fluidizing gas velocity; a second diffuser plate disposed at a bottom of the fluidized-bed furnace and having a plurality of holes for supplying a fluidizing gas with a relatively high fluidizing gas velocity; an incombustible material discharge port for discharging the incombustible material out of the fluidized-bed furnace, the incombustible material discharge port being defined between the auxiliary diffuser plate and the second diffuser plate; and a combustible material supply port disposed above the first diffuser plate for supplying the combustible material into the fluidized-bed furnace; wherein the first diffuser plate has a downwardly inclined surface directed to the incombustible material discharge port and supplies the fluidizing gas so as to fluidize a fluidized medium at a relatively low fluidizing speed and create a descending flow of the fluidized medium; the auxiliary diffuser plate has a downwardly inclined surface extending between a lower edge of the first diffuser plate and the incombustible material discharge port and directed to the incombustible material discharge port and supplies the fluidizing gas so as to fluidize the fluidized medium at a relatively high fluidizing speed, and the downwardly inclined surface of the auxiliary diffuser plate being steeper than the downwardly inclined surface of the first diffuser plate and having a lower edge substantially vertically aligned with and vertically spaced from an adjacent edge of the second diffuser plate, the incombustible material discharge port being open in a vertical gap between the lower edge of the downwardly inclined surface of the auxiliary diffuser plate and the adjacent edge of the second diffuser plate; and the second diffuser plate supplies the fluidizing gas so as to fluidize the fluidized medium at a relatively high fluidizing speed and create an upward flow of the fluidized medium.

Preferably, the fluidized-bed furnace has an inclined wall disposed above the second diffuser plate for directing the fluidizing gas and the fluidized medium flowing upwardly of the second diffuser plate toward a region above the first diffuser plate, i.e., a central region of the fluidized-bed furnace. A free board is disposed above the inclined wall. The second diffuser plate has an upwardly inclined surface which is progressively higher away from the incombustible material discharge port and supplies the fluidizing gas having a progressively increasing fluidizing gas velocity away from the incombustible material discharge port. The fluidized-bed combustor also has a thermal energy recovery chamber defined between the inclined wall and a side wall of the fluidized-bed furnace and being in communication with the central region of the fluidized-bed furnace above and below the inclined wall; a heat collector disposed in the thermal energy recovery chamber for recovering thermal energy from the fluidized medium in the thermal energy recovery chamber; and a third diffuser plate disposed between the second diffuser plate and the side wall of the fluidized-bed furnace and extending contiguously to an outer edge of the second diffuser plate, the third diffuser plate having a plurality of holes for supplying a fluidizing gas with a relatively low fluidizing gas velocity; wherein the third diffuser plate has an upwardly inclined surface which has the same gradient as the second diffuser plate and supplies the fluidizing gas to fluidize the fluidized medium at a relatively low fluidizing speed in the thermal energy recovery chamber. The bottom of the fluidized-bed furnace may be of a rectangular or circular shape. If the bottom of the fluidized-bed furnace is of a rectangular shape, then the first diffuser plate, and the second diffuser plate, which are of a rectangular shape, may be disposed parallel to each other, or alternatively, the first diffuser plate and the second diffuser plate, which are of a rectangular shape, may be disposed symmetrically with respect to a ridge of the first diffuser plate which is of a rectangular, roof-shaped structure. If the bottom of the fluidized-bed furnace is of a circular shape, then the circular bottom of the fluidized-bed furnace is composed of the first diffuser plate which is of a conical shape, the second diffuser plate which is of an inverted conical shape disposed concentrically with the first diffuser plate, and the incombustible material discharge port which is open in the vertical gap between the outer circumferential edge of the first diffuser plate and the inner circumferential edge of the second diffuser plate.

In the fluidized-bed combustor, a fluidizing gas such as air supplied from the first diffuser plate fluidizes a fluidized medium at a relatively low fluidizing speed to create a descending flow of the fluidized medium, and a fluidizing gas such as air supplied from the second diffuser plate fluidizes the fluidized medium at a relatively high fluidizing speed to create an upward flow of the fluidized medium, thus producing a main circulating fluidized bed including the descending and upward flows. After the fluidized medium descends with the descending flow, it is guided by the downwardly inclined surface of the first diffuser plate, and ascends with the upward flow in the vicinity of the second diffuser plate. Having reached an upper region of the fluidized bed, the fluidized medium is directed to the central region of the fluidized-bed furnace, and then descends with the descending flow again, with the result that a main circulating flow is generated which circulates in the main fluidized bed.

By supplying the fluidizing gas so as to fluidize the fluidized medium at a relatively large fluidizing speed from the diffuser device provided on the inner surface of the incombustible material discharge port, the fluidized medium in the region near or above the incombustible material discharge port is fluidized intensely. As a result, not a fixed bed but a fluidized bed is formed above the incombustible material discharge port, a fluidized region of the fluidized medium continues from the first diffuser plate to the second diffuser plate, and a circulating flow including a descending flow in the weak fluidized region and an upward flow in the intense fluidized region is stably formed without interrupted. The inclined wall above the second diffuser plate directs the fluidizing gas and the fluidized medium ascending upwardly of the second diffuser plate toward the central region of the fluidized-bed furnace, thereby promoting the formation of the main circulating flow.

Next, separation of incombustible material from combustible material will be described in detail. Combustible material containing incombustible material is supplied to a location above the first diffuser plate from the combustible material supply port. The fluidized medium above the first diffuser plate is slowly fluidized, and a moving bed of an intermediate state between a fixed bed and a fluidized bed is formed. Since the combustible material and the incombustible material is suspended in the fluidized medium of the moving bed, they descend together with the circulating flow in the fluidized bed, and then move horizontally toward a fluidized region above the second diffuser plate which supplies a fluidizing gas with a relatively large fluidizing gas velocity. Even though the combustible material and the incombustible material are suspended in the fluidized medium above the first diffuser plate, the fluidized medium is slowly fluidized, and material of larger specific gravity than the bulk density of the moving bed descends gradually and material of smaller specific gravity than the bulk density of the moving bed floats during the horizontal flow of the fluidized medium, thus creating specific gravity separation. As a result, the combustible material of a small specific gravity moves toward an upper region of the horizontal flow and the incombustible material of a large specific gravity moves toward a lower region of the horizontal flow. Therefore, an upper fluidized bed having a high combustible material concentration with a small specific gravity and a lower fluidized bed having a high incombustible material concentration with a large specific gravity are produced from the combustible material in the horizontal flow in the vicinity of the incombustible material discharge port.

The upper fluidized bed flows beyond the incombustible material discharge port and is mixed with the upward flow of the fluidized medium, and the combustible material in the fluidized bed is combusted in an oxidizing atmosphere and intensive fluidization. Since the upper fluidized bed has a relatively low incombustible material concentration, the combustible material in the fluidized bed is effectively combusted in the upward flow of the fluidized medium.

The lower fluidized bed having a large incombustible material concentration with a large specific gravity is guided by the downwardly inclined upper surface of the first diffuser plate toward the incombustible material discharge port, and a part of the fluidized medium and the incombustible material in the lower fluidized bed are extracted from the incombustible material discharge port. Since the fluidized medium above the first diffuser plate is in the state of a moving bed, the incombustible material of a large specific gravity, such as iron or the like is supported by the moving bed, moved toward the incombustible material discharge port, and is not deposited on the bottom of the fluidized-bed furnace.

On the other hand, by supplying the fluidizing gas so as to fluidize the fluidized medium at a relatively large fluidizing speed from the diffuser device provided on the inner surface of the incombustible material discharge port, the fluidized medium is fluidized intensely at the region near or above the incombustible material discharge port. As a result, not a fixed bed or a moving bed but an intense fluidized bed is formed at the region near or above the incombustible material discharge port, and the fluidized bed has a characteristic similar to liquid. Therefore, material of larger specific gravity than the bulk density of the fluidized bed descends and material of smaller specific gravity floats in the fluidized bed, thus creating specific gravity separation easily. Therefore, the incombustible material of a large specific gravity descends rapidly toward the inside of the incombustible material discharge port, can be easily and smoothly discharged out of the furnace. Since the incombustible material in the fluidized-bed furnace is taken out smoothly and effectively, combustion of the combustible material and formation of the fluidized bed are not prevented. The combustible material and the incombustible material are separated by the selective action of the fluidizing gas, almost all of the incombustible material is effectively taken out, and only a little amount of the fluidized medium is taken out. Therefore, loss of heat is small and the removed incombustible material can easily be processed as any combustible material contained therein is small.

The auxiliary diffuser plate has a downwardly inclined surface steeper than the downwardly inclined surface of the first diffuser plate and supplies a fluidizing gas so as to fluidize the fluidized medium at a relatively high fluidizing speed. Therefore, since the moving bed above the first diffuser plate is converted into the fluidized bed above the auxiliary diffuser plate, the selective action for the incombustible material is rapidly performed, and the incombustible material of a large specific gravity such as iron descends rapidly onto the auxiliary diffuser plate. However, since the auxiliary diffuser plate has the steeply downwardly inclined surface, the incombustible material of a large specific gravity is smoothly guided toward the incombustible material discharge port. The second diffuser plate has an upwardly inclined surface which is higher away from the incombustible material discharge port and supplies the fluidized gas having a progressively increasing fluidizing gas velocity away from the incombustible material discharge port, thereby promoting the formation of the main circulating flow.

The third diffuser plate supplies a fluidizing gas so as to fluidize the fluidized medium in the thermal energy recovery chamber at a relatively low fluidizing speed and create a moving bed which moves downwardly in the thermal energy recovery chamber.

A part of the fluidized medium from the upper region of the upward flow is introduced into the thermal energy recovery chamber beyond an upper end of the inclined wall. In the thermal energy recovery chamber the fluidized medium descends as a moving bed and is cooled by a heat exchange carried out by the heat collector in the thermal energy recovery chamber. Thereafter, the fluidized medium is guided along the third diffuser plate toward the second diffuser plate, where it is mixed with the upward flow and heated by the heat of combustion in the upward flow. In this manner, an auxiliary circulating flow of the fluidized medium is formed by the descending flow in the thermal energy recovery chamber and the upward flow in the main combustion chamber, and the heat of combustion in the fluidized-bed furnace is collected by the heat collector in the thermal energy recovery chamber. Since the overall heat-transfer coefficient of the heat collector varies greatly depending on the fluidizing gas velocity as shown in FIG. 10 of the accompanying drawings, the amount of collected thermal energy can easily be controlled by varying the amount of the fluidizing gas which passes through the third diffuser plate.

In the case where the fluidized-bed furnace is of a rectangular shape as viewed in plan, it can be designed and manufactured relatively easily. However, in the case where the fluidized-bed furnace is of a circular shape as viewed in plan, the pressure resistance of the side wall of the fluidized-bed furnace can be increased. Therefore, it is possible to keep a low pressure lower than the atmospheric pressure in the fluidized-bed furnace for preventing odors and harmful gases produced upon combustion of waste material from leaking out of the fluidized-bed furnace, or alternatively to keep a high pressure in the fluidized-bed furnace for producing a high-pressure combustion gas capable of operating a gas turbine.

According to another aspect of the present invention, one of the diffuser plates adjacent to the incombustible material discharge port has a lower edge substantially vertically aligned with and vertically spaced from an adjacent edge of the other of the diffuser plates as viewed in plan, and the incombustible material discharge port is open in a vertical gap between the edges of the diffuser plates. Therefore, the fluidized medium can be fluidized at the region above the incombustible material discharge port without the diffuser device provided on the inner surface of the incombustible material discharge port. As a result, a fluidized region of the fluidized medium continues from the first diffuser plate to the second diffuser plate, and a circulating flow including a descending flow in the weak fluidized region and an upward flow in the intense fluidized region is stably formed without interrupted.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
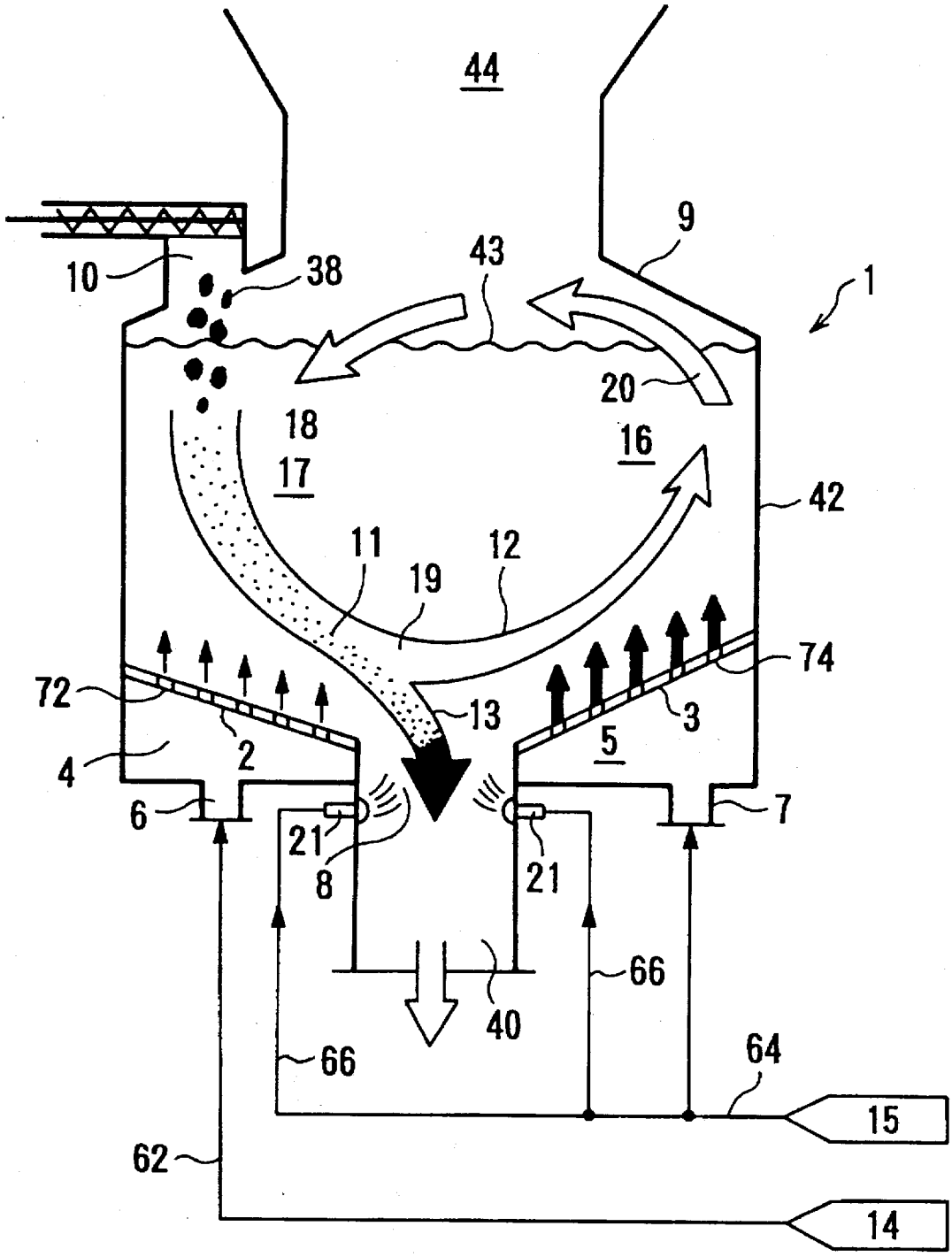
FIG. 1 is a schematic vertical cross-sectional view of a fluidized-bed combustor according to a first embodiment of the present invention.

Like or corresponding parts are denoted by like or corresponding reference numerals throughout views.

FIG. 1 shows in schematic vertical cross section a fluidized-bed combustor according to a first embodiment of the present invention.

As shown in FIG. 1, the fluidized-bed combustor according to the first embodiment comprises an incombustible material discharge port 8 disposed centrally in the bottom of a fluidized-bed furnace 1, and a first diffuser plate 2 and a second diffuser plate 3 which are disposed in the fluidized-bed furnace 1 between the incombustible material discharge port 8 and a side wall 42 of the fluidized-bed furnace 1. The fluidized-bed combustor further comprises a combustible material supply port 10 disposed above the first diffuser plate 2, an inclined wall 9 disposed above the second diffuser plate 3, and a free board 44 disposed above the inclined wall 9. The fluidized-bed furnace 1 may be of a rectangular or circular shape when viewed in plan, i.e. from above. A main fluidized bed is formed in the fluidized-bed furnace 1 when a fluidized medium composed of incombustible particles such as sand is blown upwardly into a fluidized state by a fluidizing gas such as air that is introduced upwardly into the fluidized-bed furnace 1 from the first diffuser plate 2 and the second diffuser plate 3. The main fluidized bed has a varying upper surface 43 positioned somewhere in the height of the inclined wall 9.

A first diffuser chamber 4 defined below the first diffuser plate 2 is supplied with a fluidizing gas such as air from a gas supply 14 through a pipe 62 and a connector 6. The fluidizing gas in the first diffuser chamber 4 is supplied through a number of fluidizing gas supply holes 72 defined in the first diffuser plate 2 into the fluidized-bed furnace 1 at a relatively low fluidizing gas velocity, thus forming a weak fluidized-bed region 17 of the fluidized medium above the first diffuser plate 2. In the weak fluidized-bed region 17, the fluidized medium produces a descending flow 18. The first diffuser plate 2 has a downwardly inclined upper surface which, in vertical cross section, is progressively lower toward the incombustible material discharge port 8. In FIG. 1, the descending flow 18 is converted into a substantially horizontal flow 19 along the downwardly inclined upper surface of the first diffuser plate 2 in the vicinity of the upper surface of the first diffuser plate 2.

The second diffuser plate 3 has a number of fluidizing gas supply holes 74 defined therein, and defines a second diffuser chamber 5 therebelow. The second diffuser chamber 5 is supplied with a fluidizing gas such as air from a gas supply 15 through a pipe 64 and a connector 7. The fluidizing gas in the second diffuser chamber 5 is supplied through the fluidizing gas supply holes 74 into the fluidized-bed furnace 1 at a relatively high fluidizing gas velocity, thus forming an intense fluidized-bed region 16 of the fluidized medium above the second diffuser plate 3. In the intense fluidized-bed region 16, the fluidized medium produces an upward flow 20. The second diffuser plate 3 has an upwardly inclined upper surface which, in vertical cross section, is lowest near the incombustible material discharge port 8 and progressively higher toward the side wall 42.

The fluidized medium in the fluidized-bed furnace 1 moves from an upper region of the upward flow 20 into an upper region of the weak fluidized-bed region 17, i.e., an upper region of the descending flow 18, descends with the descending flow 18, and moves from the horizontal flow 19 into a lower region of the upward flow 20, thereby creating a main circulating flow. The inclined wall 9 is progressively higher from the side wall 42 toward the center of the fluidized-bed furnace 1 for forcibly directing the upward flow 20 toward a region above the first diffuser plate 2.

The combustible material supply port 10, which is positioned above the first diffuser plate 2, charges combustible material 38 into a region above the first diffuser plate 2 in the fluidized-bed furnace 1. The combustible material 38 supplied from the combustible material supply port 10 is mixed with the descending flow 18 of the fluidized medium, and descends with the descending flow 18 toward the bottom of the fluidized-bed furnace 1 while being thermally decomposed or partially combusted. Then, the combustible material 38 is mixed with the horizontal flow 19 of the fluidized medium along the downwardly inclined upper surface of the first diffuser plate 2, and moves horizontally toward the incombustible material discharge port 8. The combustible material in the horizontal flow 19 is subjected to a selective action of the upwardly supplied fluidizing gas, and is separated into incombustible material 11 of a greater specific gravity in a lower region of the horizontal flow 19 and combustible material of a smaller specific gravity in an upper region of the horizontal flow 19. Therefore, an upper fluidized bed 12 having a high combustible material concentration with a small specific gravity and a lower fluidized bed 13 having a high incombustible material concentration with a large specific gravity are produced in the horizontal flow 19 in the vicinity of the incombustible material discharge port 8.

The upper fluidized bed 12 flows beyond the incombustible material discharge port 8 and is mixed with the upward flow 20 of the fluidized medium, and the combustible material in the fluidized bed is combusted in an oxidizing atmosphere and intensive fluidization. Combustion gases produced in the fluidized bed flow beyond the upper surface 43 of the fluidized bed upwardly into the free board 44 wherein they are subjected to secondary combustion, dust removal, and thermal energy recovery. Thereafter the combustion gases are discharged into the atmosphere. The fluidized medium and the incombustible material in the lower fluidized bed 13 are extracted from the incombustible material discharge port 8. Specifically, the fluidized medium and the incombustible material in the lower fluidized bed 13 are discharged out of the fluidized-bed furnace 1 from the incombustible material discharge port 8 through a passage 40, and a hopper, a discharge damper, or the like (not shown) which are connected to the passage 40. The fluidized medium that is taken together with the incombustible material out of the fluidized-bed furnace 1 is retrieved by a suitable means (not shown), and returned to the fluidized-bed furnace 1.

The volume of air to be blown out from or supplied through the first diffuser plate 2 is controlled in such a manner that the fluidizing gas velocity slows to a velocity of approximately 1 to 2.5 times the minimum fluidizing gas velocity (Umf). The volume of air to be blown out from or supplied through the second diffuser plate 3 is controlled in such a manner that the fluidizing gas velocity achieves a high velocity of approximately 4 to 12 times the minimum fluidizing gas velocity (Umf).

In the fluidized-bed combustor shown in FIG. 1, the fluidizing gas is supplied from the gas supply 15 through the pipe 64, branch pipes 66, and nozzles 21 into the passage 40. From the passage 40, the fluidizing gas is introduced through the incombustible material discharge port 8 upwardly into the fluidized-bed furnace 1, and fluidizes the fluidized medium above the incombustible material discharge port 8 to form a main fluidized bed that is continuous from the region above the first diffuser plate 2 to the region above the second diffuser plate 3 for thereby stabilizing the main circulating flow of the fluidized medium.

The second diffuser plate 3, which has the upwardly inclined upper surface that is progressively higher away from the incombustible material discharge port 8, gradually converts the upper fluidized bed 12 separated from the horizontal flow which moves substantially horizontally along the downwardly inclined upper surface of the first diffuser plate 2 toward the region above the incombustible material discharge port 8, into the upward flow 20. Thus the main circulating flow of the fluidized medium is stabilized and incombustible material is prevented from being deposited on the second diffuser plate 3. The fluidizing gas velocity of the fluidizing gas supplied from the second diffuser plate 3 may be progressively greater away from the incombustible material discharge port 8 so that the main circulating flow is effectively formed.

Figure 2:
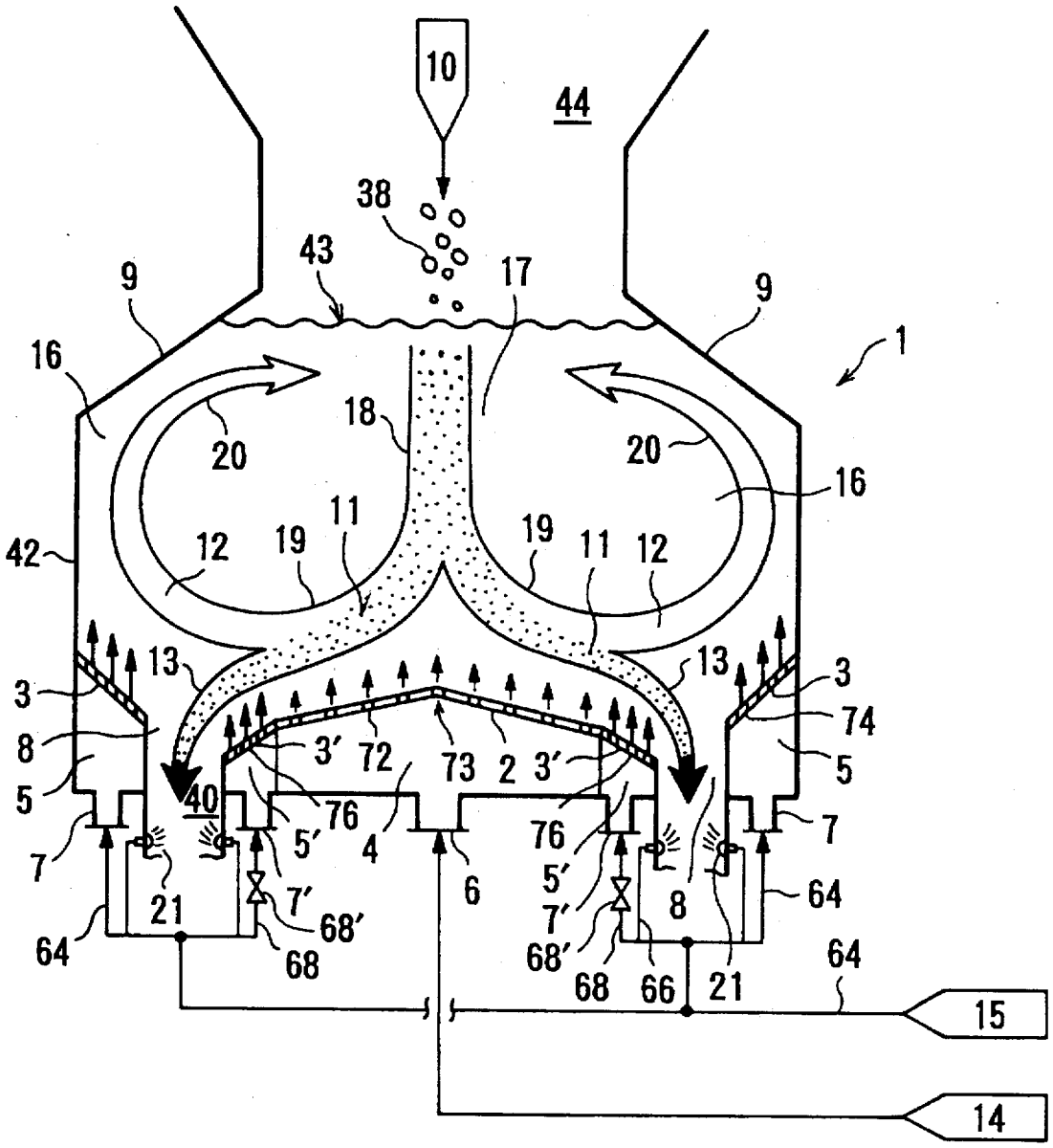
FIG. 2 is a schematic vertical cross-sectional view of a fluidized-bed combustor according to a second embodiment of the present invention.

FIG. 2 shows in schematic vertical cross section a fluidized-bed combustor according to a second embodiment of the present invention.

As shown in FIG. 2, the fluidized-bed combustor according to the second embodiment comprises a first diffuser plate 2 disposed centrally on the bottom of a fluidized-bed furnace 1, auxiliary diffuser plates 3' disposed on opposite sides of the first diffuser plate 2 and each having a number of fluidizing gas supply holes 76 defined therein, and incombustible material discharge ports 8 and a second diffuser plate 3 which are disposed between the auxiliary diffuser plates 3' and a side wall 42 of the fluidized-bed furnace 1. The fluidized-bed combustor further comprises a combustible material supply port 10 disposed above the first diffuser plate 2, an inclined wall 9 disposed above the second diffuser plate 3, and a free board 44 disposed above the inclined wall 9.

The first diffuser plate 2 has a downwardly inclined upper surface which, in vertical cross section, is highest at its center and progressively lower toward the incombustible material discharge ports 8. If the fluidized-bed furnace 1 has a circular horizontal cross-sectional shape, then the upper surface of the first diffuser plate 2 is of a conical shape. In FIG. 2, a descending flow 18 of a fluidized medium in the fluidized-bed furnace 1 is divided, in a region near a central crest 73 of the first diffuser plate 2, into two substantially horizontal flows 19 flowing in opposite directions along the downwardly inclined upper surface of the first diffuser plate 2. If the fluidized-bed furnace 1 has a circular horizontal cross-sectional shape, then the second diffuser plate 3 has an inverted conical upper surface which has an outer circumferential edge higher than its inner circumferential edge.

The first diffuser plate 2 has outer edges joined to the auxiliary diffuser plates 3' having a number of fluidizing gas supply holes 76, below which auxiliary diffuser chambers 5' are defined. The auxiliary diffuser chambers 5' are supplied with a fluidizing gas from a gas supply 15 through a pipe 64, branch pipes 68, valves 68', and connectors 7'. The fluidizing gas in the auxiliary diffuser chambers 5' is introduced through the fluidizing gas supply holes 76 into the fluidized-bed furnace 1 at a relatively high fluidizing gas velocity, thereby fluidizing a fluidized medium above the auxiliary diffuser plates 3'. The volume of air to be blown out from the auxiliary diffuser plates 3' is controlled in such a manner that the fluidizing gas velocity achieves a high velocity of approximately 4 to 12 times the minimum fluidising gas velocity (Umf).

The fluidized medium in the fluidized-bed furnace 1 moves from upper regions of upward flows 20 into an upper region of a weak fluidized-bed region 17, i.e., an upper region of the descending flow 18, descends with the descending flow 18, and moves from horizontal flows 19 into lower regions of the upward flows 20, thereby creating a main circulating flow. The descending flow 18, which is composed of a moving bed, is divided, near the central crest 73 of the first diffuser plate 2, into two substantially horizontal flows 19 flowing in opposite directions along the downwardly inclined upper surface of the first diffuser plate 2. If the fluidized-bed furnace 1 has a rectangular horizontal cross-sectional shape, then two left and right main circulating flows are generated in the fluidized-bed furnace 1.

Since the horizontal flows 19 over the first diffuser plate 2 are a moving bed in which the fluidized medium is fluidized to a relatively small degree, the incombustible material such as iron which has a large specific gravity in the horizontal flows 19 is not deposited on the bottom of the fluidized-bed furnace 1, but is moved. When the horizontal flows 19 reach regions above the auxiliary diffuser plates 3', the moving bed is turned into a moving bed having a large fluidizing speed by the fluidizing gas supplied from the auxiliary diffuser plates 3'. Therefore, the incombustible material of a large specific gravity is rapidly settled down due to the selective action of the fluidizing gas. The auxiliary diffuser plates 3' are steeper than the first diffuser plate 2, so that the settled incombustible material of a large specific gravity is moved by gravity along the downwardly inclined surfaces of the auxiliary diffuser plates 3' toward the incombustible material discharge ports 8.

The other details of the fluidized-bed combustor shown in FIG. 2 will not be described in detail below because it is substantially the same as the fluidized-bed combustor shown in FIG. 1 except that it has the auxiliary diffuser plates 3' and the auxiliary diffuser chambers 5', and the first diffuser plate 2, the incombustible material discharge ports 8 and the second diffuser plate 3 are symmetrical with respect to the center of the fluidized-bed furnace 1.

Figure 3:
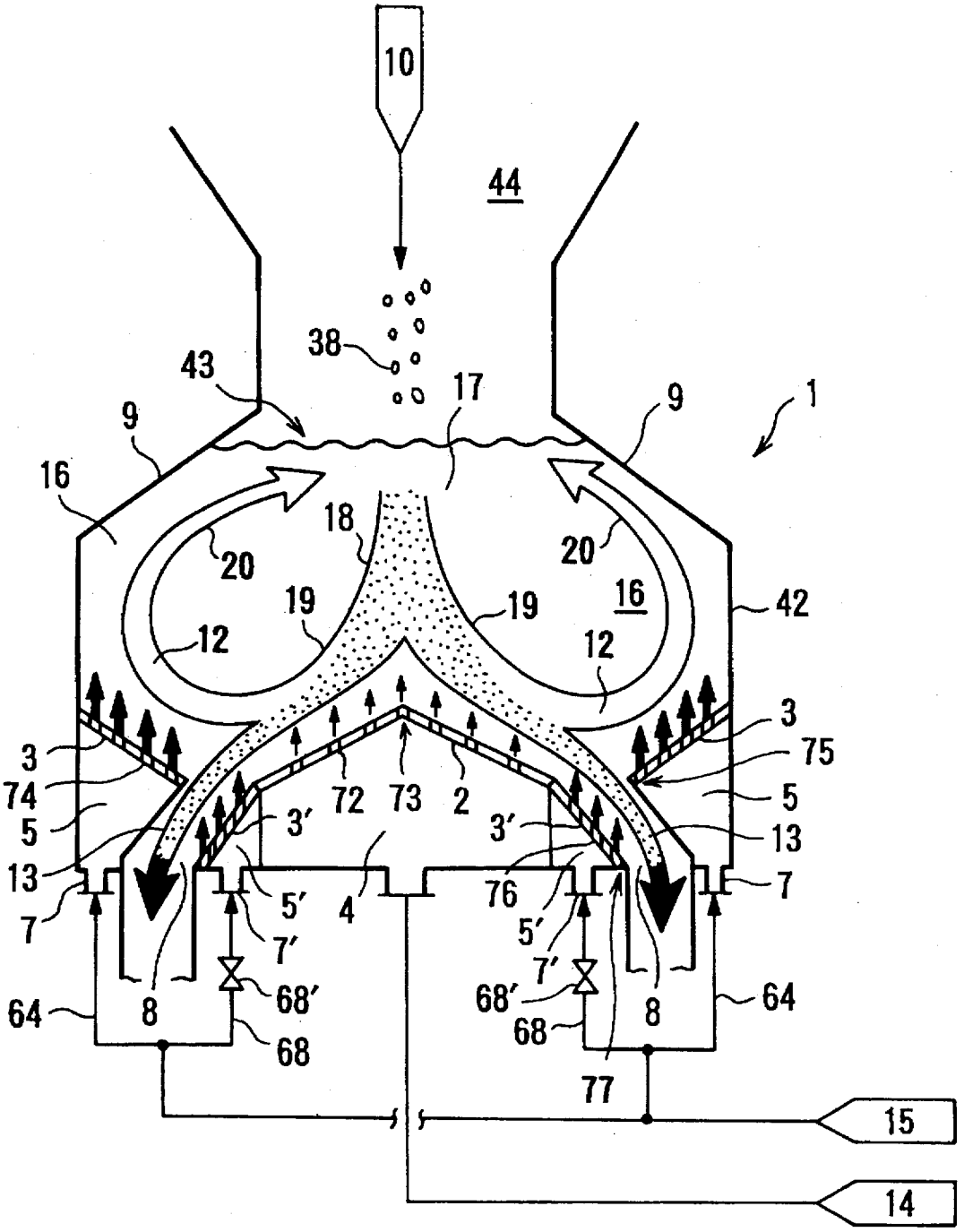
FIG. 3 is a schematic vertical cross-sectional view of a fluidized-bed combustor according to a third embodiment of the present invention.

FIG. 3 shows in schematic vertical cross section a fluidized-bed combustor according to a third embodiment of the present invention.

As shown in FIG. 3, a fluidized-bed furnace 1 has auxiliary diffuser plates 3' which are steeper than the auxiliary diffuser plates 3' shown in FIG. 2, and have a lower edge 77 lying in vertical alignment with, but vertically spaced from, a lower edge 75 of a second diffuser plate 3 adjacent thereto. Each of the incombustible material discharge ports 8 is open laterally through a vertical gap between the lower edge 77 and the lower edge 75. A fluidizing gas is not supplied from the incombustible material discharge ports 8, and the incombustible material discharge ports 8 are not open in a horizontal plan and hence do not interrupt upward flows of the fluidizing gas. Therefore, the incombustible material discharge ports 8 do not disturb a main circulating flow of the fluidized medium.

The other details of the fluidized-bed combustor shown in FIG. 3 will not be described in detail below because they are substantially the same as those of the fluidized-bed combustor shown in FIGS. 1 and 2.

Figure 4:
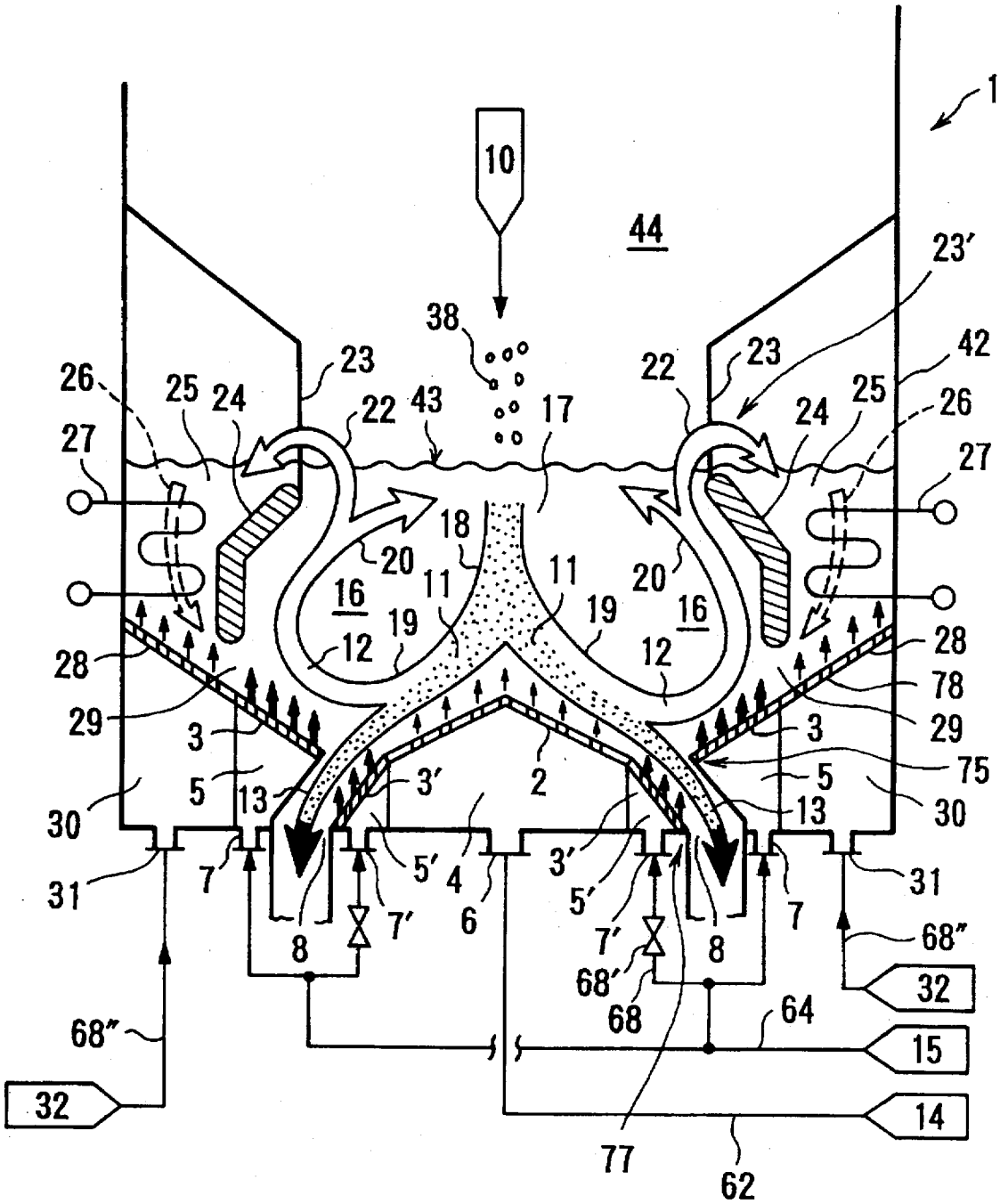
FIG. 4 is a schematic vertical cross-sectional view of a fluidized-bed combustor according to a fourth embodiment of the present invention.

FIG. 4 shows in schematic vertical cross section a fluidized-bed combustor according to a fourth embodiment of the present invention.

As shown in FIG. 4, a fluidized-bed furnace 1 has incombustible material discharge ports 8 which are open laterally through vertical gaps between lower edges 75, 77. A fluidizing gas is not supplied from the incombustible material discharge ports 8. The fluidized-bed furnace 1 has a main combustion chamber at the central part thereof and a thermal energy recovery chamber 25 adjacent to the main combustion chamber. The thermal energy recovery chamber 25 is defined between an inclined wall 24 above a second diffuser plate 3 and a side wall 42 of the fluidized-bed furnace 1, and houses heat collectors 27. The inclined wall 24 has a vertical downward extension. A third diffuser plate 28, which has substantially the same gradient as the second diffuser plate 3, extends radially outwardly from an outer edge of the second diffuser plate 3 toward the side wall 42 beyond a region onto which the inclined wall 24 is vertically projected.

The lower edge of the vertical downward extension of the inclined wall 24 is spaced from the third diffuser plate 28 by a vertical gap which serves as a lower communication passage 29 between the main combustion chamber and a lower region of the thermal energy recovery chamber 25. A plurality of vertical screen pipes 23 are disposed between an upper edge of the inclined wall 24 and the side wall 42, and define therebetween upper communication passages 23' between the main combustion chamber and an upper region of the thermal energy recovery chamber 25. A gas supply 32 is connected to a third diffusion chamber 30 defined below the third diffuser plate 28 through pipes 68" and connectors 31. A fluidizing gas is supplied from the third diffusion chamber 30 through a number of fluidizing gas supply holes 78 defined in the third diffuser plate 28 into the thermal energy recovery chamber 25 at a relatively low fluidizing gas velocity, thereby producing auxiliary circulating flows 26 in which a fluidized medium descends. The volume of air to be blown out from the third diffuser plate 28 is controlled in such a manner that the fluidizing gas velocity slows to a velocity of approximately 1 to 2.5 times the minimum fluidizing gas velocity (Umf).

Figure 10:
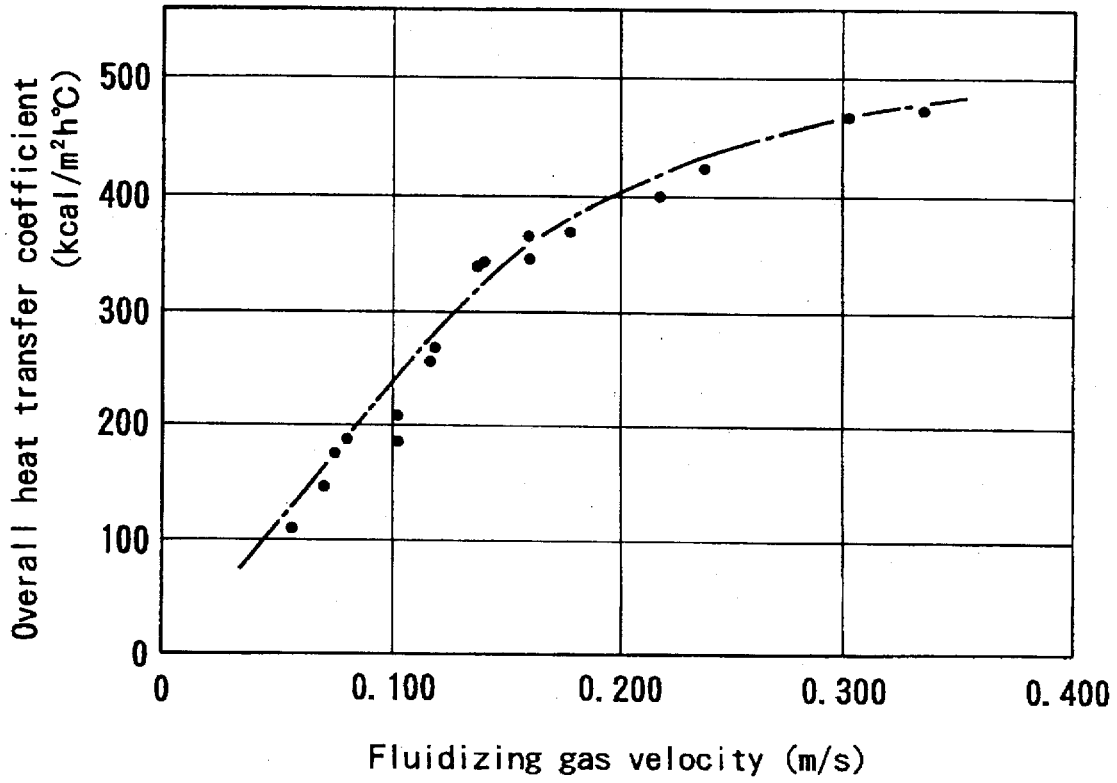
FIG. 10 is a graph showing the relationship between the overall heat-transfer coefficient of a heat collector and the fluidizing gas velocity supplied from a third diffuser plate in the fluidized-bed combustor according to the present invention.

A portion of a fluidized medium in upward flows 20 directed toward the central region of the fluidized-bed furnace 1 by the inclined wall 24 becomes reversed flows 22 passing through the upper communication passages 23' above the inclined wall 24. The reversed flows 22 enter an upper region of the thermal energy recovery chamber 25, in which they descend as descending flows. The descending flows pass through the lower communication passage 29, are mixed with the upward flows 20 of main circulating flows, and ascend and reach upper regions of the upward flows 20, thus creating the auxiliary circulating flows 26 of the fluidized medium which pass through the thermal energy recovery chamber 25. The fluidized medium in the auxiliary circulating flows 26 is cooled by a heat exchange carried out by the heat collectors 27 in the thermal energy recovery chamber 25, and then heated by the heat of combustion in the upward flows 20. Since the overall heat-transfer coefficient of the heat collectors 27 varies greatly depending on the fluidizing gas velocity as shown in FIG. 10, the amount of collected thermal energy can effectively be controlled by varying the amount of the fluidizing gas which passes through the third diffuser plate 28.

In the fluidized-bed combustor shown in FIGS. 1 and 2, the fluidizing gas is supplied from the incombustible material discharge port 8, and the main fluidized bed is free of interrupted regions, so that a stable main circulating flow is generated. In the fluidized-bed combustor shown in FIGS. 3 and 4, the lower edges of the auxiliary diffuser plates 3' are vertically spaced from the lower edge of the adjacent second diffuser plate 3 so as to define the incombustible material discharge port 8 in the vertical gap between the spaced lower edges. The flow of the fluidizing gas supplied upwardly from the bottom of the fluidized-bed furnace is free of interrupted regions, and hence a stable fluidized bed is created in the same manner as the fluidized-bed combustor shown in FIGS. 1 and 2.

Figure 5:
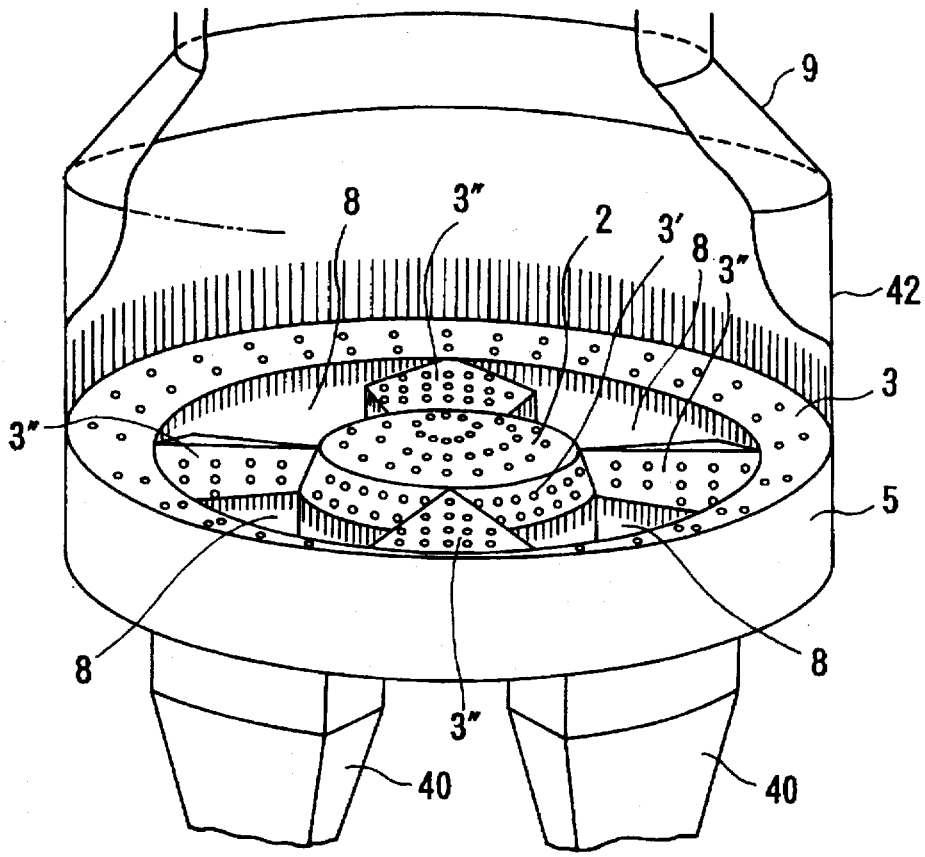
FIG. 5 is a perspective view of the bottom of a fluidized-bed combustor according to a fifth embodiment of the present invention.
Figure 6:
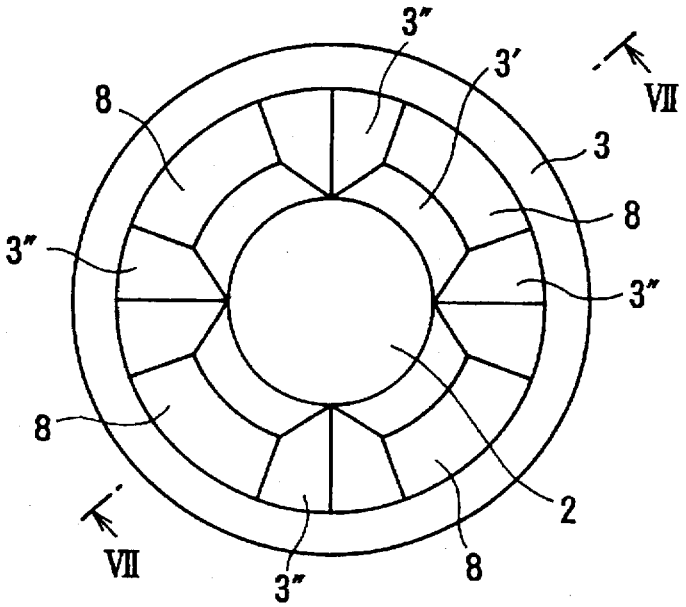
FIG. 6 is a plan view of the bottom of the fluidized-bed combustor shown in FIG. 5.
Figure 7:
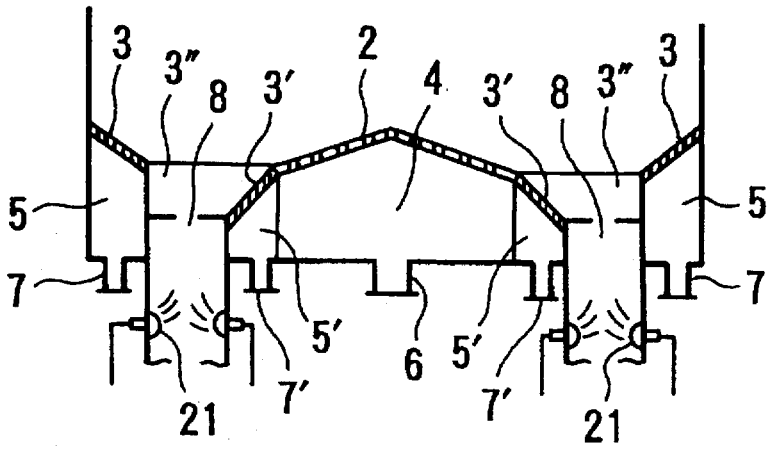
FIG. 7 is a cross-sectional view taken along line VII—VII of FIG. 6.

FIGS. 5, 6, and 7 are perspective, plan, and cross-sectional views, respectively, of the circular bottom of a fluidized-bed combustor according to a fifth embodiment of the present invention. The fluidized-bed combustor according to the fifth embodiment corresponds to the fluidized-bed combustor shown in FIG. 2 where the fluidized-bed furnace is of a circular shape as viewed in plan. The cross-sectional view shown in FIG. 7 is taken along line VII—VII of FIG. 6. As shown in FIGS. 5, 6, and 7, a first diffuser plate 2 has a conical surface with its center being higher than its circumferential edge. An annular auxiliary air diffusion plate 3', four arcuate incombustible material discharge ports 8, and a second diffuser plate 3 are disposed concentrically around the first diffuser plate 2. The annular auxiliary air diffusion plate 3' has an inclined surface steeper than the inclined surface of the central first diffuser plate 2. The second diffuser plate 3 has an annular inverted conical surface with its inner circumferential edge being lower than its outer circumferential edge. A second diffuser chamber 5 defined below the second diffuser plate 3 is of an annular shape.

In FIGS. 5, 6, and 7, four fourth diffuser plates 3" are disposed radially between the four arcuate incombustible material discharge ports 8. Each of the fourth diffuser plates 3" has two downwardly inclined surfaces directed toward the two incombustible material discharge ports 8 that are positioned one on each side thereof. The volume of air to be blown out from the fourth diffuser plate 3" is controlled in such a manner that the fluidizing gas velocity achieves a high velocity of approximately 4 to 12 times the minimum fluidizing gas velocity (Umf). The downwardly inclined surfaces of each of the fourth diffuser plates 3" serve to guide incombustible material having a large specific gravity toward the incombustible material discharge ports 8, thereby preventing those incombustible material from being deposited on the fourth diffuser plates 3". The other structural details and functions of the fluidized-bed combustor according to the fifth embodiment are substantially the same as those of the fluidized-bed combustor according to the second embodiment shown in FIG. 2, and will not be described in detail.

Figure 8:
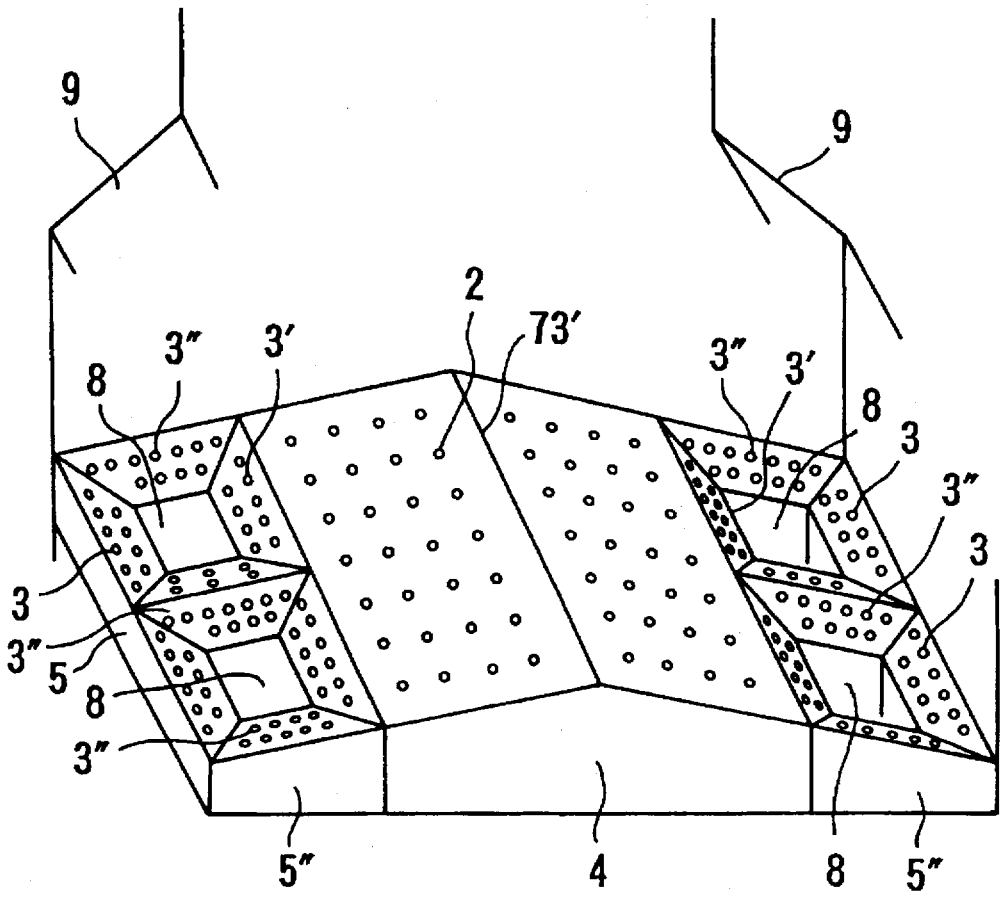
FIG. 8 is a perspective view of the bottom of a fluidized-bed combustor according to a sixth embodiment of the present invention.

FIG. 8 shows in perspective view the bottom of a fluidized-bed furnace of a fluidized-bed combustor according to a sixth embodiment of the present invention. The fluidized-bed combustor according to the sixth embodiment corresponds to the fluidized-bed combustor shown in FIG. 2 where the fluidized-bed furnace is of a rectangular shape as viewed in plan. In FIG. 8, a first diffuser plate 2 is of a rectangular shape as viewed in plan, and has a roof-shaped structure formed by two oppositely upwardly inclined plate members joined at a central ridge 73'. The first diffuser plate 2, auxiliary air diffusion plates 3', incombustible material discharge ports 8, and second diffuser plates 3 are disposed symmetrically with respect to the central ridge 73', and are rectangular in shape. The fluidized-bed combustor shown in FIG. 8 includes fourth diffuser plates 3" extending perpendicularly to the ridge 73' and along edges of the incombustible material discharge ports 8, and having downwardly inclined surfaces directed toward the incombustible material discharge ports 8. The downwardly inclined surfaces of the fourth diffuser plates 3" serve to guide incombustible material having a large specific gravity toward the incombustible material discharge ports 8, thereby preventing the incombustible material from being deposited on the fourth diffuser plates 3". The other structural details and functions of the fluidized-bed combustor according to the sixth embodiment are substantially the same as those of the fluidized-bed combustor according to the second embodiment shown in FIG. 2, and will not be described in detail.

Figure 9:
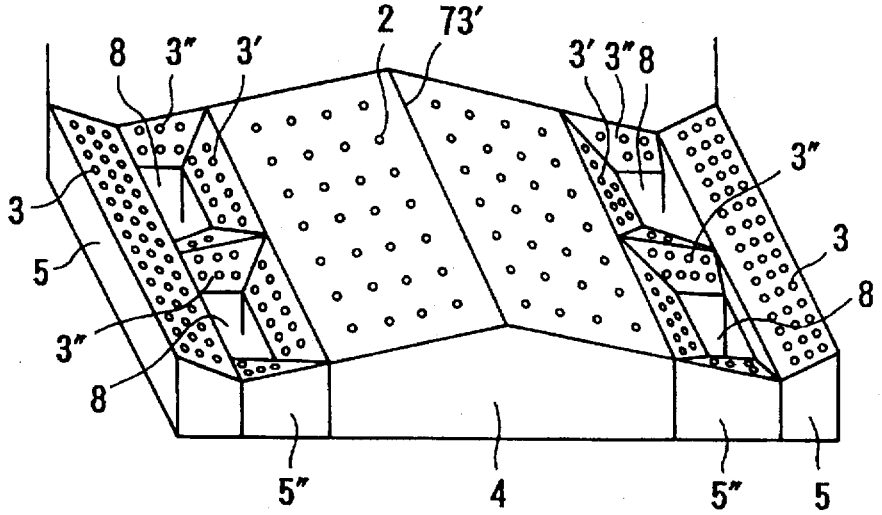
FIG. 9 is a perspective view of the bottom of a fluidized-bed combustor according to a seventh embodiment of the present invention.

FIG. 9 shows in perspective view the bottom of a fluidized-bed furnace of a fluidized-bed combustor according to a seventh embodiment of the present invention. The fluidized-bed combustor according to the seventh embodiment corresponds to the fluidized-bed combustor shown in FIG. 2 where the fluidized-bed furnace is of a rectangular shape as viewed in plan, and is essentially similar to the fluidized-bed combustor according to the sixth embodiment shown in FIG. 8. In the fluidized-bed combustor according to the seventh embodiment, second diffuser plates 3 have edges located adjacent to incombustible material discharge ports 8 and lying in the planes of extensions of inclined surfaces of a first diffuser plate 2, and also have edges located adjacent to a side wall of the fluidized-bed furnace and lying above the planes of the extensions of the inclined surfaces of the first diffuser plate 2. The other structural details and functions of the fluidized-bed combustor according to the seventh embodiment are substantially the same as those of the fluidized-bed combustor according to the second and sixth embodiments shown in FIGS. 2 and 8, and will not be described in detail.

Since the fluidized-bed combustor according to the sixth and seventh embodiments shown in FIGS. 8 and 9 have fewer curved surfaces than the fluidized-bed combustor according to the other embodiments, they can be designed and machined relatively easily, and can be manufactured relatively inexpensively.

FIG. 10 is a graph showing the relationship between the overall heat-transfer coefficient of the heat collector and the fluidizing gas velocity of a fluidizing gas supplied from the third diffuser plate 28 in the fluidized-bed combustor according to the present invention. As shown in FIG. 10, the overall heat-transfer coefficient of the heat collector varies greatly depending on the fluidizing gas velocity in a fluidizing gas velocity range from 0 to 0.3 m/s, particularly from 0.05 to 0.25 m/s. Therefore, when the fluidizing gas velocity in the thermal energy recovery chamber is adjusted in the above range, the overall heat-transfer coefficient of the heat collector can be varied to control the amount of collected thermal energy in a wide range.

The present invention offers the following advantages:

(1) In the fluidized-bed combustor, a main circulating flow including descending and upward flows of a fluidized medium is created, and combustible material is charged into an upper region of the descending flow, is mixed with the main circulating flow, and combusted. The fluidized-bed combustor can uniformly combust combustible material such as waste even if sizes, incombustible contents and specific gravity thereof vary.

(2) Combustible material moves in descending and upward flows while being combusted and decomposed, and incombustible material of a large specific gravity, while gradually separated from combustible material of a small specific gravity by the selective action of a fluidizing gas, is guided along a downwardly inclined surface of a first diffuser plate toward an incombustible material discharge port. In the incombustible discharge port the incombustible material is rapidly settled and separated by the intensive selective action of the fluidizing gas, and then smoothly removed from the fluidized-bed furnace. Therefore, no incombustible material is deposited in the fluidized-bed furnace, and any fault caused by incombustible material is minimized in the supply of the fluidizing gas, the combustion of the combustible material, and the recovery of thermal energy. The removed incombustible material can easily be processed as any combustible material contained therein is small.

(3) Inasmuch as a part of a fluidizing gas is supplied from an incombustible material discharge port or an incombustible material discharge port is open laterally, but not upwardly, so that the fluidizing gas is supplied from the entire bottom surface of the fluidized-bed furnace for thereby creating a stable main circulating flow of fluidized medium, it is possible to combust combustible material uniformly and operate the fluidized-bed combustor smoothly, and also possible to combust combustible material completely or gasify combustible material highly efficiently by adjusting the amount of air for combustion.

(4) Inasmuch as a thermal energy recovery chamber is defined between an inclined wall and a furnace side wall, and a third diffuser plate having substantially the same gradient as that of a second diffuser plate and also having a downwardly inclined surface directed toward an incombustible material discharge port is disposed below the thermal energy recovery chamber, incombustible material in the heat thermal energy recovery chamber is smoothly guided to the incombustible material discharge port, and the recovery of thermal energy is not disturbed. Because the heat transfer coefficient of a heat collector can be varied greatly by adjusting a fluidizing gas from the third diffuser plate, it is easy to adjust the amount of recovery of thermal energy.

Although certain preferred embodiments of the present invention have been shown and described in detail, it should be understood that various changes and modifications may be made therein without departing from the scope of the appended claims.

What is claimed is:

1. A fluidized-bed combustor for combusting combustible material containing incombustible material in a fluidized-bed furnace and comprising:

a first diffuser plate disposed at a bottom of said fluidized-bed furnace and having a plurality of holes for supplying fluidizing gas with a relatively low fluidizing gas velocity;

a second diffuser plate disposed at a bottom of said fluidized-bed furnace and having a plurality of holes for supplying fluidizing gas with a relatively high fluidizing gas velocity;

a combustible material supply port disposed above said first diffuser plate for supplying combustible material into said fluidized-bed furnace; and an incombustible material discharge port for discharging the incombustible material out of said fluidized-bed furnace, said incombustible material discharge port being defined between said first diffuser plate and said second diffuser plate;

a diffuser device for supplying fluidizing gas through said incombustible material discharge port into said fluidized-bed furnace;

said first diffuser plate having a surface inclined downwardly toward said incombustible material discharge port and operable to supply fluidizing gas to fluidize a fluidized medium at a relatively low fluidizing speed and create a descending flow of the fluidized medium; and said second diffuser plate being operable to supply fluidizing gas to fluidize the fluidized medium at a relatively high fluidizing speed and create an upward flow of the fluidized medium.

2. A fluidized bed combustor according to claim 1, further comprising an auxiliary diffuser plate disposed between said first diffuser plate and said incombustible material discharge port and having a plurality of holes for supplying fluidizing gas so as to fluidize the fluidized medium at a relatively high fluidizing speed, said auxiliary diffuser plate having a surface inclined downwardly and extending between a lower edge of said first diffuser plate and said incombustible material discharge port at an inclination steeper than said first diffuser plate.

3. A fluidized-bed combustor according to claim 2, further comprising an inclined wall disposed above said second diffuser plate for directing fluidizing gas and fluidized medium flowing upwardly of said second diffuser plate toward a central region of said fluidized-bed furnace, and said second diffuser plate having an upwardly inclined surface which is progressively higher away from said incombustible material discharge port and being operable to supply fluidizing gas at a fluidizing gas velocity that progressively increases away from said incombustible material discharge port.

4. A fluidized-bed combustor according to claim 3, further comprising a thermal energy recovery chamber defined between said inclined wall and a side wall of said fluidized-bed furnace and being in communication with the central region of said fluidized-bed furnace above and below said inclined wall, a heat collector disposed in said thermal energy recovery chamber for recovering thermal energy from the fluidized medium in said thermal energy recovery chamber, a third diffuser plate disposed between said second diffuser plate and said side wall of said fluidized-bed furnace and extending contiguously to an outer edge of said second diffuser plate, said third diffuser plate having a plurality of holes for supplying fluidizing gas at a relatively low fluidizing gas velocity, and said third diffuser plate having an upwardly inclined surface having the same inclination as said second diffuser plate and operable to supply fluidizing gas to fluidize the fluidized medium at a relatively low fluidizing speed in said thermal energy recovery chamber.

5. A fluidized-bed combustor according to claim 1, further comprising an inclined wall disposed above said second diffuser plate for directing fluidizing gas and fluidized medium flowing upwardly of said second diffuser plate toward a central region of said fluidized-bed furnace, and said second diffuser plate having an upwardly inclined surface which is progressively higher away from said incombustible material discharge port and being operable to supply fluidizing gas at a fluidizing gas velocity that progressively increases away from said incombustible material discharge port.

6. A fluidized-bed combustor according to claim 5, further comprising a thermal energy recovery chamber defined between said inclined wall and a side wall of said fluidized-bed furnace and being in communication with the central region of said fluidized-bed furnace above and below said inclined wall, a heat collector disposed in said thermal energy recovery chamber for recovering thermal energy from the fluidized medium in said thermal energy recovery chamber, a third diffuser plate disposed between said second diffuser plate and said side wall of said fluidized-bed furnace and extending contiguously to an outer edge of said second diffuser plate, said third diffuser plate having a plurality of holes for supplying fluidizing gas at a relatively low fluidizing gas velocity, and said third diffuser plate having an upwardly inclined surface having the same inclination as said second diffuser plate and operable to supply fluidizing gas to fluidize the fluidized medium at a relatively low fluidizing speed in said thermal energy recovery chamber.

7. A fluidized-bed combustor according to claim 1, wherein said first diffuser plate is substantially circular as viewed from above and has a conical configuration including a central region higher than a circumferential edge thereof, a plurality of arcuate incombustible material discharge ports are disposed concentrically with said first diffuser plate, and said second diffuser plate is of an annular shape disposed concentrically with said first diffuser plate.

8. A fluidized-bed combustor according to claim 7, further comprising a fourth diffuser plate provided between each pair of adjacent incombustible material discharge ports and having two downwardly inclined surfaces directed toward respective said adjacent incombustible material discharge ports.

9. A fluidized-bed combustor as claimed in claim 1, wherein said first diffuser plate is substantially rectangular as viewed from above and includes two oppositely upwardly inclined plate members joined at a central upper ridge that is higher than opposite lateral edges of said first diffuser plate, and at least one combustible material discharge port is disposed adjacent each said opposite lateral edge.

10. A fluidized-bed combustor as claimed in claim 9, comprising plural incombustible material discharge ports disposed adjacent each said opposite lateral edge and spaced in a direction parallel to said central upper ridge.

11. A fluidized-bed combustor according to claim 10, further comprising a fourth diffuser plate provided between each pair of adjacent incombustible material discharge ports and having two downwardly inclined surfaces directed toward respective said adjacent incombustible material discharge ports.

* * * * *